US011078914B2

(12) United States Patent
Shi et al.

(10) Patent No.: US 11,078,914 B2
(45) Date of Patent: Aug. 3, 2021

(54) HEMISPHERICAL ENTRAINMENT-TYPE HIGH-FLOW SELF-PRIMING CENTRIFUGAL PUMP

(71) Applicant: Jiangsu University, Jiangsu (CN)

(72) Inventors: Weidong Shi, Jiangsu (CN); Hao Chang, Jiangsu (CN); Wei Li, Jiangsu (CN); Jianrui Liu, Jiangsu (CN); Ling Zhou, Jiangsu (CN); Chuan Wang, Jiangsu (CN)

(73) Assignee: Jiangsu University, Jiangsu (CN)

( * ) Notice: Subject to any disclaimer, the term of this patent is extended or adjusted under 35 U.S.C. 154(b) by 0 days.

(21) Appl. No.: 16/966,007

(22) PCT Filed: Apr. 13, 2018

(86) PCT No.: PCT/CN2018/082953
§ 371 (c)(1),
(2) Date: Jul. 30, 2020

(87) PCT Pub. No.: WO2019/184010
PCT Pub. Date: Oct. 3, 2019

(65) Prior Publication Data

US 2020/0355185 A1 Nov. 12, 2020

(30) Foreign Application Priority Data

Mar. 26, 2018 (CN) ..... 201810250634.0

(51) Int. Cl.
*F04D 9/02* (2006.01)
*F04D 1/00* (2006.01)
*F04D 9/06* (2006.01)

(52) U.S. Cl.
CPC ..... *F04D 9/02* (2013.01); *F04D 1/00* (2013.01); *F04D 9/065* (2013.01)

(58) Field of Classification Search
CPC ..... F04D 9/06; F04D 9/065
See application file for complete search history.

(56) References Cited

U.S. PATENT DOCUMENTS 2,897,764 A * 8/1959 Tracy ..... F04D 9/001 417/83
6,682,313 B1 * 1/2004 Sulmone ..... F04D 9/06 417/199.2
2004/0175279 A1 * 9/2004 Ramacciotti ..... F04D 9/048 417/307

FOREIGN PATENT DOCUMENTS

CN 101429941 5/2009
CN 101922454 12/2010
(Continued)

*Primary Examiner* — Peter J Bertheaud
*Assistant Examiner* — Geoffrey S Lee
(74) *Attorney, Agent, or Firm* — JCIP Global Inc.

(57) ABSTRACT

A hemispherical entrainment-type high-flow self-priming centrifugal pump includes a hemispherical entrainment system, a pump body and a pump inlet pipe. The hemispherical entrainment system is disposed above the pump body. The hemispherical entrainment system comprises four layers of entrainment cavities, including a spherical entrainment interior cavity, a primary entrainment cavity, a secondary entrainment cavity and a tertiary entrainment cavity. The spherical entrainment interior cavity is a double circular pipeline that ascends in a spiral overlapping manner to wrap a hemispherical surface, and improves the entrainment capacity, while increasing the entrainment area. The primary entrainment cavity is allowed to be in communication with the secondary entrainment cavity and the tertiary entrainment cavity by upward sliding of a sliding check core. The secondary entrainment cavity entrains the gas in the pump inlet pipe, and the primary entrainment cavity entrains the gas in a pump cavity.

10 Claims, 7 Drawing Sheets

(56) References Cited

FOREIGN PATENT DOCUMENTS

| | | | | | |
|---|---|---|---|---|---|
| CN | 202370856 | | | 8/2012 | |
| CN | 204663902 | | | 9/2015 | |
| GB | 1157767 | A | * | 7/1969 | ..... F04D 9/065 |
| JP | 2012072702 | | | 4/2012 | |
| JP | 2013057277 | | | 3/2013 | |

* cited by examiner

HEMISPHERICAL ENTRAINMENT-TYPE HIGH-FLOW SELF-PRIMING CENTRIFUGAL PUMP

CROSS-REFERENCE TO RELATED APPLICATION

This application is a 371 of international application of PCT application serial no. PCT/CN2018/082953, filed on Apr. 13, 2018, which claims the priority benefit of China application no. 201810250634.0, filed on Mar. 26, 2018. The entirety of each of the above mentioned patent applications is hereby incorporated by reference herein and made a part of this specification.

BACKGROUND

Technical Field

The present invention relates to a high-flow self-priming centrifugal pump, and in particular, to a hemispherical entrainment-type high-flow self-priming centrifugal pump.

Description of Related Art

The high-flow self-priming centrifugal pump is widely used in military, municipal, firefighting and other emergency water delivery projects due to its unique self-priming principle. However, the traditional high-flow self-priming centrifugal pumps currently used in the market are mainly self-priming centrifugal pumps with outer recirculation and self-priming centrifugal pumps with inner recirculation, which have long self-priming time, low efficiency and poor performance. Although jet self-priming centrifugal pumps can effectively improve the self-priming performance, they often require additional auxiliary devices, and also need to be equipped with at least two working motors, which will generate a lot of noise and make the operation of the whole machine more complicated. At the same time, the jet self-priming centrifugal pumps cannot be adjusted according to the difference in the gas-liquid content during the self-priming process, causing blockage of self-priming channels, which will affect the self-priming process.

SUMMARY

In view of the deficiencies in the prior art, the present invention provides a hemispherical entrainment-type high-flow self-priming centrifugal pump, which entrains the gas in the pump cavity, while entraining the gas in the inlet pipeline, so that the air in the high-flow self-priming centrifugal pump is rapidly discharged, and the self-priming process is completed efficiently and rapidly.

The present invention achieves the above technical object through the following technical solutions.

The present invention provides a hemispherical entrainment-type high-flow self-priming centrifugal pump, including a hemispherical entrainment system, a pump body, and a pump inlet pipe. The hemispherical entrainment system is disposed above the pump body and comprises an elliptical cross-section pipeline, a housing, a primary separation plate, a secondary separation plate, a spherical entrainment upper cover plate, a spherical entrainment lower cover plate and a sliding check core. The elliptical cross-section pipeline is inclined upward at a certain angle and has a top end connected to a bottom end of the housing, the housing is vertically arranged, the secondary separation plate is disposed in the housing and has a periphery connected to an inner wall of the housing, and the primary separation plate is disposed at a top end of the housing, each of the primary separation plate and the secondary separation plate is provided with a through-hole at a center thereof, and the sliding check core is connected with the through-holes at the centers of the primary separation plate and the secondary separation plate in a manner of a sliding pair, and the primary separation plate, the secondary separation plate and the housing constitute a secondary entrainment cavity therebetween, the secondary separation plate and the elliptical cross-section pipeline constitute a primary entrainment cavity therebetween, and the secondary entrainment cavity is in communication with the pump inlet pipe, thereby realizing entrainment of gas in the pump inlet pipe. Each of the spherical entrainment upper cover plate and the spherical entrainment lower cover plate has a bottom end connected to the primary separation plate, and the spherical entrainment upper cover plate and the spherical entrainment lower cover plate are engaged with each other to form a spherical entrainment interior cavity having a cross-section that is double circular, and the spherical entrainment interior cavity is a double circular pipeline that ascends in a spiral overlapping manner to wrap a hemispherical surface, the double circular pipeline has a bottom inlet connected to an air inlet, and a top outlet connected to an air outlet, and the spherical entrainment lower cover plate and the primary separation plate constitute a tertiary entrainment cavity therebetween, the spherical entrainment lower cover plate has spherical entrainment through-holes evenly distributed thereon, and the tertiary entrainment cavity is in communication with the spherical entrainment interior cavity via the spherical entrainment through-holes. The sliding check core has a top end and a bottom end limited by an upper limit spring and a lower limit spring, respectively, and is provided with a plurality of primary entrainment pipes and secondary entrainment pipes thereinside, the primary entrainment pipes are respectively in communication with the secondary entrainment pipes, and the primary entrainment pipes and the secondary entrainment pipes are both evenly distributed circumferentially around an axis of the sliding check core, both ends of each of the primary entrainment pipes are located on a side surface of the sliding check core. In an initial state, each of the primary entrainment pipes has a top outlet being directly opposite the primary separation plate, and a bottom inlet being directly opposite the secondary entrainment cavity, and each of the secondary entrainment pipes has a top port in communication with a respective one of the primary entrainment pipes, and a bottom port located at a bottom surface of the sliding check core. The elliptical cross-section pipeline is provided with a sliding valve thereinside, the sliding valve has an elliptical cylindrical structure and is provided with an inner pipeline, the inner pipeline has an outlet having a direction that is parallel to a central axis of the elliptical cross-section pipeline, and an inlet has a direction perpendicular to the central axis of the elliptical cross-section pipeline, the sliding valve is connected with an inner wall of the elliptical cross-section pipeline in a manner of a sliding pair, the elliptical cross-section pipeline is provided with an entrainment hole for a pump cavity, and during upward and downward sliding movement of the sliding valve, the inlet of the inner pipeline is configured to be in communication or misalignment with the entrainment hole for the pump cavity, thereby adjusting an opening for entrainment of gas in the pump body, the elliptical cross-section pipeline is provided with a thrust valve on the inner wall, the thrust valve is located above the sliding valve and is used to limit a position where the sliding valve slides upward, the sliding valve and a bottom surface of the elliptical cross-section pipeline constitute a gas storage cavity, and the elliptical cross-section pipeline is provided with a vent hole on the bottom surface thereof, and the vent hole is used to communicate the gas storage cavity with an atmosphere.

Preferably, each of the primary entrainment pipes is provided with a second-stage round platform-shaped exit section and a first-stage round platform-shaped exit section sequentially at the top outlet, the second-stage round platform-shaped exit section and the first-stage round platform-shaped exit section have a same central axis, and the second-stage round platform-shaped exit section has a diameter larger than that of the first-stage round platform-shaped exit section. In the initial state, the second-stage round platform-shaped exit section is directly opposite the primary separation plate.

Preferably, the sliding check core is provided with a plurality of drainage nozzles thereinside, which are evenly distributed circumferentially around the central axis of the first-stage round platform-shaped exit section, and each of the drainage nozzles extends from the first-stage round platform-shaped exit section to the second-stage round platform-shaped exit section, and becomes a constricted jet nozzle at an outlet of each of the drainage nozzles, so that at late phase of self-priming, a high-speed gas-liquid two-phase flow jet generated by the drainage nozzles causes a uniform radial impact on a gas-liquid two-phase flow discharged from the second-stage round platform-shaped exit section, leading to condensation and collection of liquid phase in the tertiary entrainment cavity to avoid blocking the entrainment pipes.

Preferably, each of the primary entrainment pipes has an inclined contraction section and a one-turn section sequentially from the bottom inlet to the top outlet, and each of the secondary entrainment pipes has an inclined contraction section and a vertical contraction section sequentially from the bottom port to the top port. The top port of each of the secondary entrainment pipes is in communication with the inclined contraction section of each of the primary entrainment pipes. Therefore, two local contractions and accelerations are achieved through the secondary entrainment pipe along a pipeline entrainment direction, thereby not only allowing the entrainment under the pressure difference between the tertiary entrainment cavity and the primary entrainment cavity, but also leading to secondary entrainment of the secondary entrainment pipe due to the exit section of the secondary entrainment pipe being in communication with the contraction section of the primary entrainment pipe to form a high speed and low pressure at the exit section of the secondary entrainment pipe.

Preferably, the sliding check core is provided with an upper positioning groove at the top end. The upper limit spring has a bottom end installed in the upper positioning groove, and a top end connected with a positioning ball which is installed above the top end of the sliding check core via a limit bracket. The sliding check core is provided with a positioning groove at the bottom end. The lower limit spring has a top end fixed in the positioning groove, and a bottom end fixed in a lower positioning groove located on an inner surface of the elliptical cross-section pipeline. The upper limit spring and the lower limit spring are used to realize the space limit of the sliding check core, thereby facilitating the adjustment of the opening of the entrainment pipes.

Preferably, a ratio of elastic modulus of the upper limit spring to the lower limit spring is 1:2.

Preferably, the thrust valve has a right triangle-shaped cross-section. When the sliding valve slides up to the top end of the elliptical cross-section pipeline, it can completely fit the thrust valve, and along an axial direction of the elliptical cross-section pipeline, a top surface of the thrust valve is flush with a bottom surface of the outlet of the inner pipeline in the sliding valve, thereby enabling water that returns to the primary entrainment cavity at the end of self-priming to be completely discharged into the pump body through the sliding valve.

Preferably, the thrust valve sweeps through an elliptical ring of 120° on the inner surface of the elliptical cross-section pipeline.

Preferably, the gas storage cavity is semi-ellipsoidal in shape.

Preferably, the primary separation plate has an upper surface which is an oblique plane inclined downward, and a lower surface which is an arc surface inclined downward.

Preferably, the thrust valve is made of rubber material, the sliding valve is made of silicon carbide material, and the rest of the structure is processed and formed from aluminum alloy.

Preferably, the angle between the elliptical cross-section pipeline and the horizontal plane is 25°-60°.

The present invention has the following advantageous effects.

1) In the present invention, the hemispherical entrainment system is used. The hemispherical entrainment system includes four layers of entrainment cavities, in which the secondary entrainment cavity entrains the gas in the pump inlet pipe, and the primary entrainment cavity entrains the gas in the pump cavity, thereby improving the traditional single structure that only performs the entrainment on the pump inlet pipe, efficiently improving the self-priming efficiency, and greatly saving the self-priming time.

2) In the hemispherical entrainment system of the present invention, the spherical entrainment structure is used, which improves the entrainment capacity, while increasing the entrainment area, thereby effectively avoiding the disadvantages from, for example, inefficient entrainment of single-stage jet nozzles and large volume of multi-stage linear nozzles.

3) In the present invention, the structure of drainage nozzles is adopted. At the late phase of self-priming, the gas-liquid two-phase flow from the second-stage round platform-shaped exit section is impacted by the radial two-phase flow jet from the circumference, which further allows the liquid phase in the two-phase flow to condense together after the collision of the gas-liquid two-phase flow, and to be collected in the tertiary entrainment cavity, so as to avoid blocking the self-priming pipeline and affecting the self-priming process.

4) In the present invention, the sliding check core is adopted. The sliding check core slides up and down in the through-holes at the centers of two stages of separation plates, thereby adjusting the opening between the three layers of entrainment cavities, which further reduces energy loss and improves energy efficiency. Moreover, the gas in the secondary entrainment pipe in the sliding check core is not only affected by the pressure difference between the primary entrainment cavity and the tertiary entrainment cavity, but also subjected to the secondary entrainment due to the outlet of the secondary entrainment pipe being in communication with the contraction section of the primary entrainment pipe at which the flow rate is fast and the pressure is low, so that the entrainment pipes in the sliding check core have a relatively strong entrainment capacity.

At the same time, at the end of self-priming, the water which is stored in the tertiary entrainment cavity by the collision and condensation during the self-priming process may be returned to the primary entrainment cavity via the entrainment pipes, and further returned to the pump cavity, which reduces the accumulation of water in the system to avoid the corrosion to the structure so as not to affect the next self-priming start-up.

5) In the present invention, the sliding valve with the elliptical cylindrical structure is adopted, so it will not be twisted in the elliptical cross-section pipeline in order to avoid that the inlet of the inner pipeline and the entrainment hole for the pump cavity cannot be docked. Moreover, the rising height of the sliding valve in the elliptical cross-section pipeline can be adjusted based on the pressure difference between the gas storage cavity and the primary entrainment cavity, thereby adjusting the opening of the entrainment hole for the pump cavity, which realizes the adjustment of the opening of the entrainment hole for the pump cavity during the self-priming process, and improves the entrainment performance.

DESCRIPTION OF THE EMBODIMENTS

The present invention will be further described below with reference to the accompanying figures and specific embodiments, but the protection scope of the present invention is not limited thereto.

Figure 1:
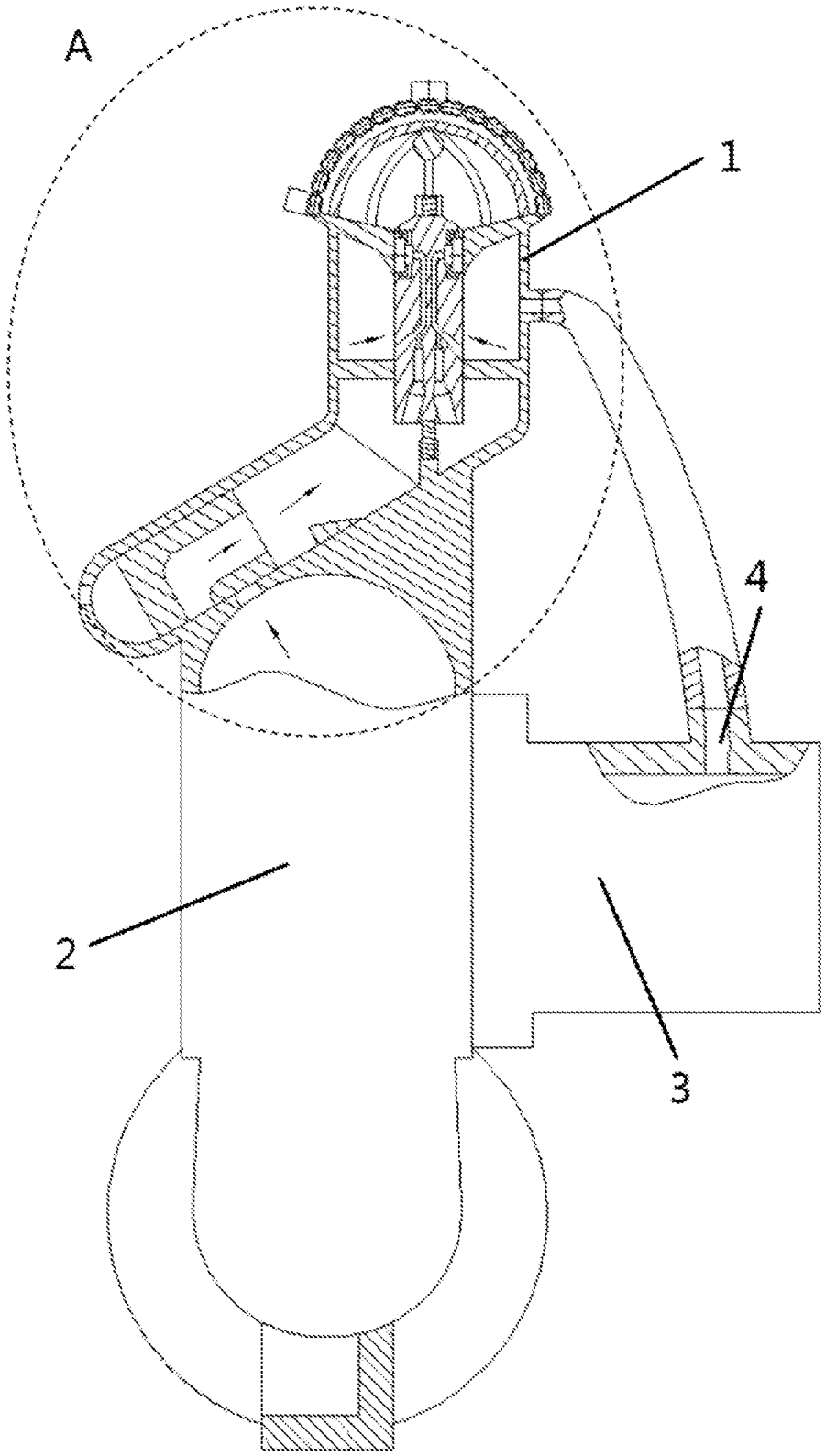
FIG. 1 is a schematic structural diagram of a hemispherical entrainment-type high-flow self-priming centrifugal pump according to the present invention.
Figure 2:
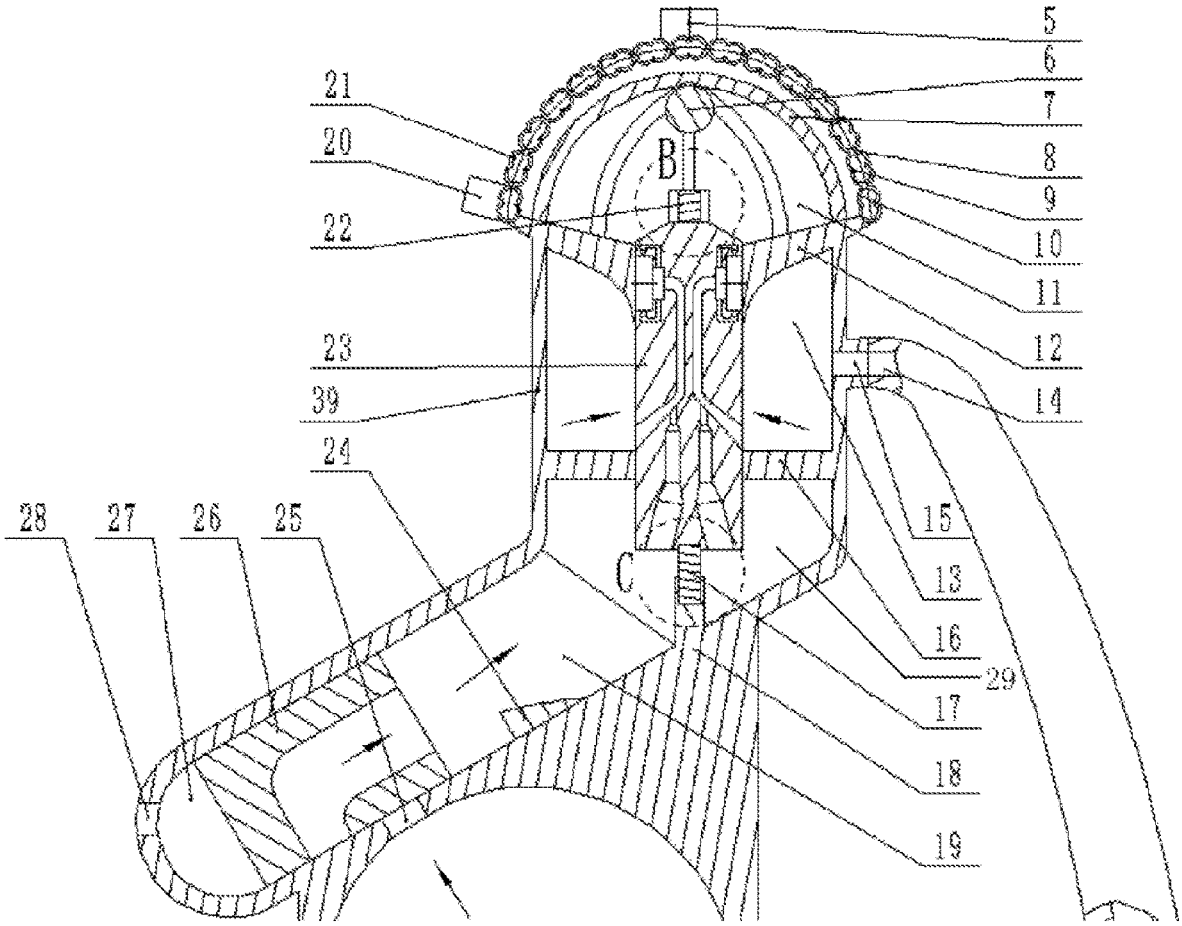
FIG. 2 is a partially enlarged view at area A in FIG. 1.

Referring to FIG. 1, the hemispherical entrainment-type high-flow self-priming centrifugal pump according to the present invention includes a hemispherical entrainment system 1, a pump body 2, and a pump inlet pipe 3. The hemispherical entrainment system 1 is disposed above the pump body 2, and includes an elliptical cross-section pipeline 19, a housing 39, a primary separation plate 12, a secondary separation plate 16, a spherical entrainment upper cover plate 8, a sliding check core 23 and a spherical entrainment lower cover plate 10, as shown in FIG. 2. The elliptical cross-section pipeline 19 is inclined upward at an angle of 25° to 60° with the horizontal plane, and has a top end connected to a bottom end of the housing 39. The housing 39 is vertically arranged. The secondary separation plate 16 is horizontally disposed in the housing 39 and has a periphery connected to an inner wall of the housing 39. The primary separation plate 12 is disposed at a top end of the housing 39. The primary separation plate 12 has an upper surface which is an oblique plane inclined downward, and a lower surface which is an arc surface inclined downward. Each of the primary separation plate 12 and the secondary separation plate 16 is provided with a through-hole at a center thereof. The sliding check core 23 is connected with the through-holes at the centers of the primary separation plate 12 and the secondary separation plate 16 in a manner of a sliding pair. The primary separation plate 12, the secondary separation plate 16 and the housing 39 constitute a secondary entrainment cavity 13 therebetween. The secondary separation plate 16 and the elliptical cross-section pipeline 19 constitute a primary entrainment cavity 29 therebetween. The housing 39 is provided with an extraction connection port 15. The extraction connection port 15 and an entrainment port 4 for inlet pipe are in communication with the respective ends of a delivery connection pipe 14 to allow the secondary entrainment cavity 13 to be in communication with the pump inlet pipe 3, thereby realizing entrainment of gas in the pump inlet pipe 3.

Figure 5:
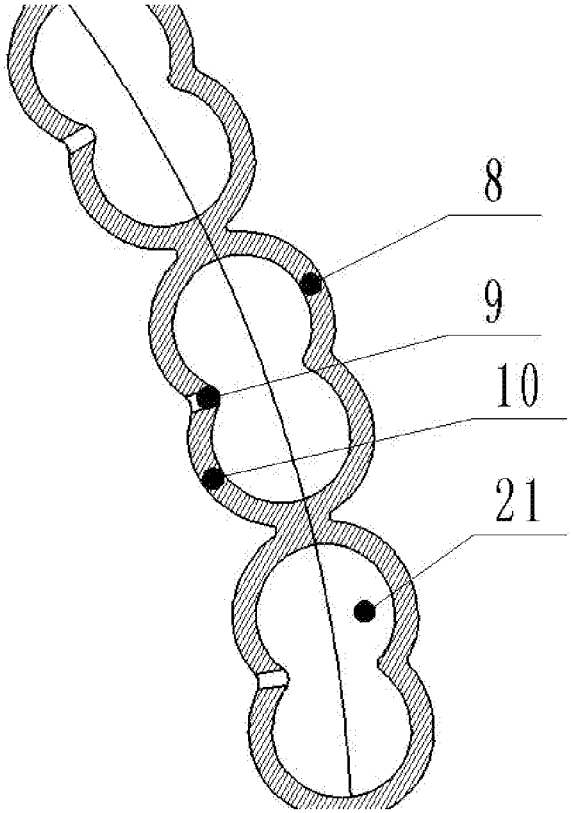
FIG. 5 is a partial enlarged view of the spherical entrainment interior cavity according to the present invention.

Each of the spherical entrainment upper cover plate 8 and the spherical entrainment lower cover plate 10 is integrally formed by die casting from aluminum alloy, and has a bottom end connected to the primary separation plate 12. The spherical entrainment upper cover plate 8 and the spherical entrainment lower cover plate 10 are engaged with each other to form a spherical entrainment interior cavity 21 whose cross-section is double circular and whose spatial structure is a double circular pipeline that ascends in a spiral overlapping manner to wrap a hemispherical surface, as shown in FIG. 5. The double circular pipeline has a bottom inlet connected to an air inlet 20, and a top outlet connected to an air outlet 5. The spherical entrainment lower cover plate 10 and the primary separation plate 12 constitute a tertiary entrainment cavity 11 therebetween. The spherical entrainment lower cover plate 10 has spherical entrainment through-holes 9 evenly distributed on it, and the spherical entrainment through-holes 9 communicate the tertiary entrainment cavity 11 with the spherical entrainment interior cavity 21.

Figure 3:
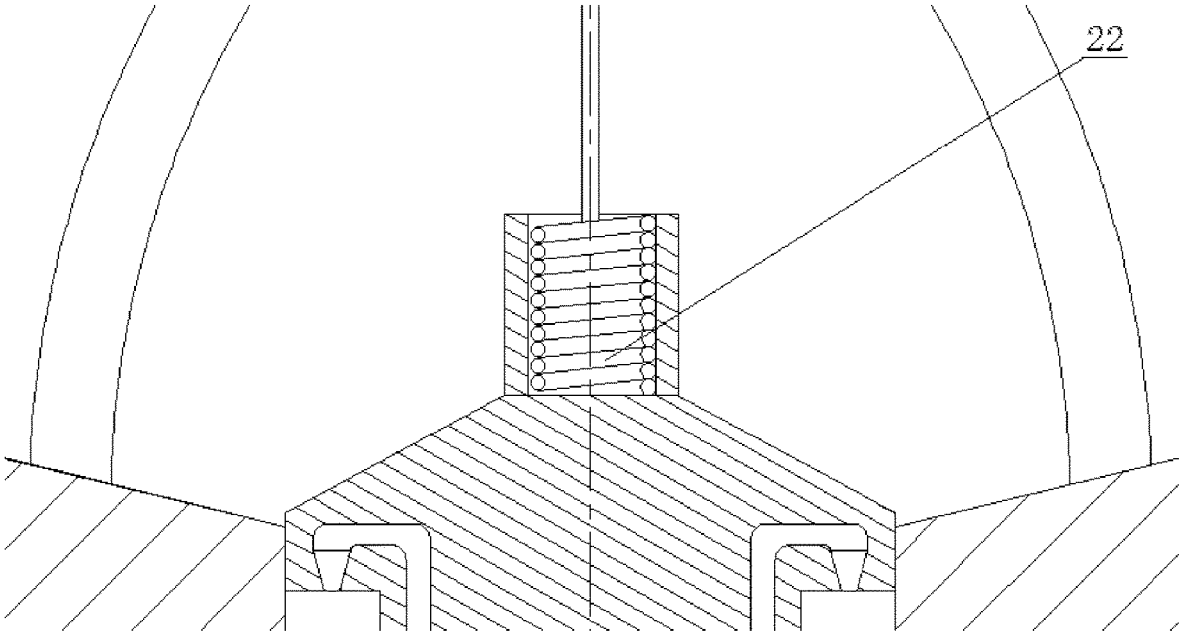
FIG. 3 is a partially enlarged view at area B in FIG. 2.
Figure 4:
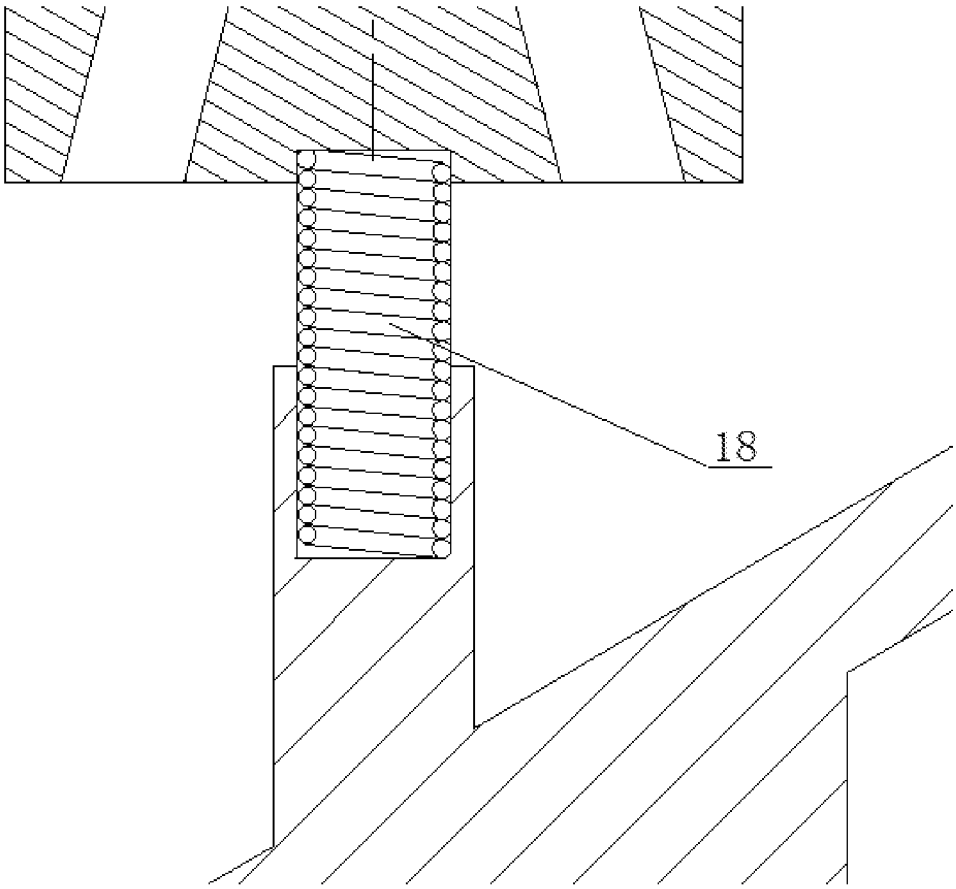
FIG. 4 is a partially enlarged view at area C in FIG. 2.
Figure 7:
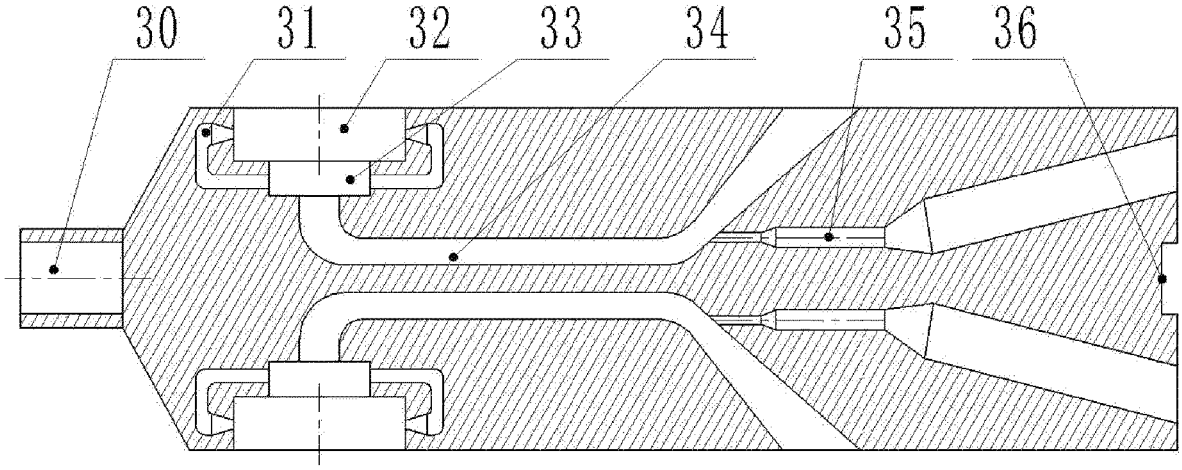
FIG. 7 is a schematic structural diagram of a sliding check core according to the present invention.

As shown in FIG. 7, the sliding check core 23 is cylindrical in shape, and its top end has a round-platform shape extending upward. As shown in FIGS. 2-4, the top end and the bottom end of the sliding check core 23 are limited by an upper limit spring 22 and a lower limit spring 17, respectively. The ratio of elastic modulus of the upper limit spring 22 to the lower limit spring 17 is 1:2. The sliding check core 23 is provided with an upper positioning groove 30 at the top end. The upper limit spring 22 has a bottom end installed in the upper positioning groove 30, and a top end connected with a positioning ball 6 which is installed above the top end of the sliding check core 23 via a limit bracket 7. The limit bracket 7 is formed into a spherical arc surface at the top end to be tightly fixed with the positioning ball 6. The sliding check core 23 is provided with a positioning groove 36 at the bottom end. The lower limit spring 17 has a top end fixed in the positioning groove 36, and a bottom end fixed in a lower positioning groove 18 located in the primary entrainment cavity 29. The lower positioning groove 18 is integrally cast with the inner surface of the elliptical cross-section pipeline 19.

As shown in FIG. 7, the sliding check core 23 is provided with a plurality of primary entrainment pipes 34 and secondary entrainment pipes 35 inside, the primary entrainment pipes 34 are in communication with the respective secondary entrainment pipes 35, and the primary entrainment pipes 34 and the secondary entrainment pipes 35 are both evenly distributed circumferentially around an axis of the sliding check core 23. A second-stage round platform-shaped exit section 32 and a first-stage round platform-shaped exit section 33 are sequentially provided at the top outlet of each of the primary entrainment pipes 34 on the sliding check core 23. The second-stage round platform-shaped exit section 32 and the first-stage round platform-shaped exit section 33 have the same central axis, and the second-stage round platform-shaped exit section 32 has a diameter larger than that of the first-stage round platform-shaped exit section 33. In the initial state, the second-stage round platform-shaped exit section 32 is directly opposite the primary separation plate 12 which seals the second-stage round platform-shaped exit section 32, and the bottom inlet of each of the primary entrainment pipes 34 is directly opposite the secondary entrainment cavity 13.

The sliding check core 23 is provided with a plurality of drainage nozzles 31 inside, which are evenly distributed circumferentially around the central axis of the first-stage round platform-shaped exit section 33, and each of the drainage nozzles 31 extends from the first-stage round platform-shaped exit section 33 to the second-stage round platform-shaped exit section 32, and becomes a constricted jet nozzle at an outlet of each of the drainage nozzles 31, so that at late phase of self-priming, a high-speed gas-liquid two-phase flow jet generated by the drainage nozzles 31 causes a uniform radial impact on a gas-liquid two-phase flow discharged from the second-stage round platform-shaped exit section 32, leading to condensation and collection of liquid phase in the tertiary entrainment cavity 11 to avoid blocking the entrainment pipes.

Each of the primary entrainment pipes 34 has an inclined contraction section and a one-turn section sequentially from the bottom inlet to the top outlet, and each of the secondary entrainment pipes 35 has an inclined contraction section and a vertical contraction section sequentially from the bottom port to the top port. Two local contractions and accelerations are achieved through the secondary entrainment pipe 35 along a pipeline entrainment direction, thereby not only allowing the entrainment under the pressure difference between the tertiary entrainment cavity 11 and the primary entrainment cavity 29, but also leading to secondary entrainment of the secondary entrainment pipe 35, because the exit section of the vertical contraction section of the secondary entrainment pipe 35 is in communication with the inclined contraction section of the primary entrainment pipe 34 and the bottom port of the secondary entrainment pipe 35 is located at a bottom surface of the sliding check core 23 to form a high speed and low pressure at the exit section of the secondary entrainment pipe 35.

After the self-priming process is completed, the sliding check core 23 falls back under its own gravity, and the elasticity of the upper limit spring 22 and the lower limit spring 17 to allow the bottom inlet of each of the primary entrainment pipes 34 to be lower than the lower surface of the secondary separation plate 16, so that the water accumulated in the tertiary entrainment cavity 11 can return to the primary entrainment cavity 29 via the primary entrainment pipes 34 and the secondary entrainment pipes 35, and return to the pump body 2 via the inner pipeline in the sliding valve 26.

Figure 6:
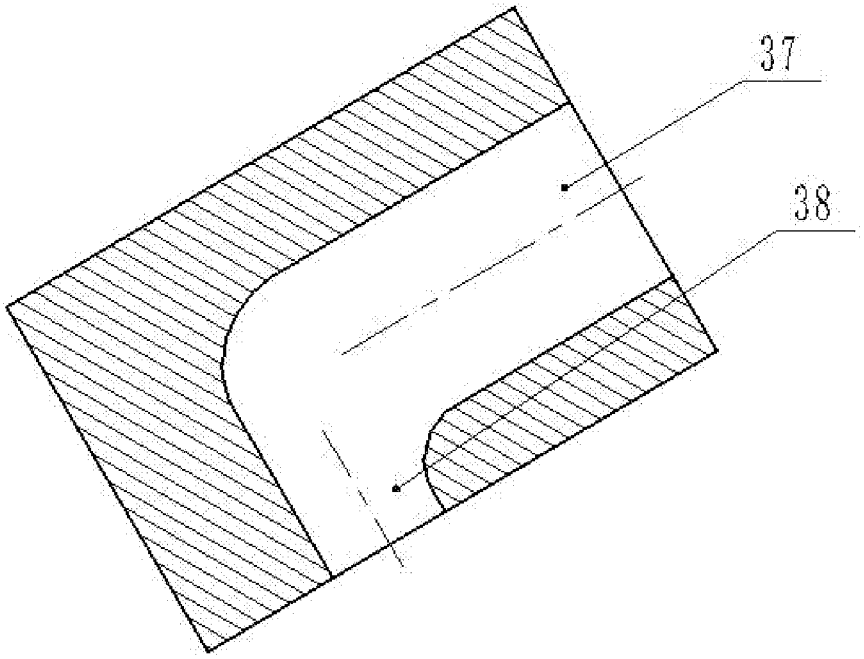
FIG. 6 is a schematic structural diagram of a sliding valve according to the present invention.

As shown in FIG. 2, the elliptical cross-section pipeline 19 has an elliptical cross-section, and is provided with the sliding valve 26 inside. As shown in FIGS. 2 and 6, the sliding valve 26 has an elliptical cylindrical structure, and is provided with a right triangle-shaped inner pipeline inside. The inner pipeline has an outlet 37 whose direction is parallel to the central axis of the elliptical cross-section pipeline, and an inlet 38 whose direction is perpendicular to the central axis of the elliptical cross-section pipeline 19. The sliding valve 26 is connected with an inner wall of the elliptical cross-section pipeline 19 in a manner of a sliding pair. The elliptical cross-section pipeline 19 is provided with an entrainment hole 25 for a pump cavity, and during upward and downward sliding movement of the sliding valve 26, the inlet 37 of the inner pipeline is configured to be in communication or misalignment with the entrainment hole 25 for the pump cavity.

As shown in FIG. 2, the elliptical cross-section pipeline 19 is provided with a thrust valve 24 on the inner wall which is located above the sliding valve 26. The thrust valve 24 has a right triangle-shaped cross-section. The thrust valve 24 sweeps through an elliptical ring of 120° on the inner surface of the elliptical cross-section pipeline 19, and a top surface of the thrust valve 24 is flush with the outlet 37 of the inner pipeline, and when the sliding valve 26 slides up to the top end of the elliptical cross-section pipeline 19, it can completely fit the thrust valve 24, thereby enabling water that returns to the primary entrainment cavity 29 at the end of self-priming to be completely discharged into the pump body 2 through the sliding valve 26. The sliding valve 26 and a bottom surface of the elliptical cross-section pipeline 19 constitute a gas storage cavity 27 which is ellipsoidal in shape. The elliptical cross-section pipeline 19 is provided with a vent hole 28 on the bottom surface which is used to communicate the gas storage cavity 27 with the atmosphere.

The thrust valve 24 is made of rubber material, the sliding valve 26 is made of silicon carbide material, and the rest of the structure is processed and formed from aluminum alloy.

The present invention has the following working process.

The high-speed gas is injected into the spherical entrainment interior cavity 21 through the air inlet 20, and gradually spirals up along the spherical entrainment interior cavity 21. Because the high-speed gas in the spherical entrainment interior cavity 21 causes the pressure to drop below the gas pressure in the tertiary entrainment cavity 11, which further causes the gas in the tertiary entrainment cavity 11 to enter the spherical entrainment interior cavity 21 through the spherical entrainment through-holes 9 under the pressure difference, spiral up along the spherical entrainment interior cavity 21 with the high-speed gas, and to be discharged through the air outlet 5, achieving the entrainment and discharge of the gas in the tertiary entrainment cavity 11.

After the gas in the tertiary entrainment cavity 11 is entrained and discharged, the pressure in the tertiary entrainment cavity 11 is reduced to be lower than the gas pressure in the primary entrainment cavity 29, leading to the sliding check core 23 to slide upward. At this time, the upper limit spring 22 is in a compressed state, and the lower limit spring 17 is in a stretched state. When the top end of the second-stage round platform-shaped exit section 32 on the sliding check core 23 is higher than the upper surface of the primary separation plate 12, the tertiary entrainment cavity 11 is in communication with the secondary entrainment cavity 13 and the primary entrainment cavity 29.

Since the gas pressure in the secondary entrainment cavity 13 is greater than the gas pressure in the tertiary entrainment cavity 11, the gas in the secondary entrainment cavity 13 is discharged to the tertiary entrainment cavity 11 after passing through the primary entrainment pipes 34 and then successively passing through the first-stage round platform-shaped exit sections 33 and the second-stage round platform-shaped exit sections 32 under the pressure difference, and is entrained by the high-speed gas in the spherical entrainment interior cavity 21, and then is discharged, which in turn causes the gas pressure in the secondary entrainment cavity 13 to decrease accordingly, thereby achieving the extraction of the gas in the inlet pipe 3 through the extraction connection port 15 via the delivery connection pipe 14.

In view of the relatively low pressure difference between the gas in the primary entrainment cavity 29 and the tertiary entrainment cavity 11 at the initial phase of self-priming, the rising height of the sliding check core 23 is relatively small, so that the area of the region in the second-stage round platform-shaped exit section 32 above the upper surface of the primary separation plate 12 is relatively small, that is, the area of the flow surface formed between the primary entrainment cavity 29 and the tertiary entrainment cavity 11 and between the primary entrainment cavity 29 and the secondary entrainment cavity 13 is relatively small, and the entrainment capacity is relatively low at this time.

With the progress of the self-priming process, the pressure difference between the gas in the primary entrainment cavity 29 and the tertiary entrainment cavity 11 gradually increases at the middle phase of self-priming, and the rising height of the sliding check core 23 increases, but at this time, although the second-stage round platform-shaped exit section 32 is not wholly above the upper surface of the primary separation plate 12, it still has a relatively strong flow capacity, so that a large amount of gas in the pump cavity is discharged.

At the late phase of self-priming, the second-stage round platform-shaped exit section 32 is wholly above the upper surface of the primary separation plate 12, and the entrained medium is no longer the single air, but a gas-liquid two-phase flow in which the liquid phase is very easy to block the self-priming flow channel in the process of entrainment. For this reason, drainage nozzles 31 are provided from the first-stage round platform-shaped exit section 33 to the second-stage round platform-shaped exit section 32, and are evenly distributed circumferentially around the central axis of the first-stage round platform-shaped exit section 33. The gas-liquid two-phase jet discharged from the drainage nozzles 31 in the radial direction impacts the gas-liquid two-phase flow discharged from the second-stage round platform-shaped exit section 32, so that the liquid in the gas-liquid two-phase flow condenses together after collision. Since the second-stage round platform-shaped exit section 32 is wholly above the upper surface of the primary separation plate 12, the liquid is collected in the tertiary entrainment cavity 11 and cannot enter the sliding check core 23 through the first-stage round platform-shaped exit section and the second-stage round platform-shaped exit section 32.

At the same time, during the self-priming process, the gas pressure in the tertiary entrainment cavity 11 is lower than the gas pressure in the primary entrainment cavity 29. On the one hand, the gas in the primary entrainment cavity 29 enters the primary entrainment pipe 34 after two contractions and accelerations through the secondary entrainment pipe 35, and is discharged into the primary entrainment cavity 29 with the gas in the secondary entrainment cavity 13 entrained by the primary entrainment pipe 34, and then is discharged. On the other hand, due to the secondary entrainment pipe 35 being in communication with the contraction section of the primary entrainment pipe 34, after the gas is accelerated by the contraction section of the primary entrainment pipe 34, the pressure is reduced, thereby realizing the secondary entrainment of the gas in the secondary entrainment pipe 35, which enhances the entrainment capacity of the hemispherical entrainment system.

With the progress of the self-priming process, the gas pressure in the primary entrainment cavity 29 is continuously reduced and gradually lower than the atmospheric pressure, and the gas storage cavity 27 is provided with the vent hole 28 on the wall surface, which is in direct communication with the atmosphere, that is, the pressure in the gas storage cavity 27 is atmospheric pressure. Therefore, under the pressure difference, the sliding valve 26 slides upward along the elliptical cross-section pipeline 19. Since the sliding valve 26 has an elliptical cylindrical structure, it will not be twisted in the elliptical cross-section pipeline 19 in order to avoid that the inlet 38 of the sliding valve 26 and the entrainment hole 25 for the pump cavity cannot be docked. At the initial phase of self-priming, the pressure difference between the primary entrainment cavity 29 and the gas storage cavity 27 is relatively small, and the sliding valve 26 slides up to a lower height, so that the docking area between the inlet 38 of the sliding valve 26 and the entrainment hole 25 for the pump cavity is relatively small, and the entrainment capacity for the gas in the pump cavity is relatively weak at this time. At the middle phase of the self-priming, the sliding valve 26 continues to slide upwards, the docking area between the inlet 38 of the inner pipeline and the entrainment hole 25 for the pump cavity is increased, and the entrainment capacity for the gas in the pump cavity is enhanced. At the late phase of the self-priming, the sliding valve 26 slides up to the top end of the elliptical cross-section pipeline 19, and fits the thrust valve 24. At this time, the inlet 38 of the inner pipeline is completely docked with the entrainment hole 25 for the pump cavity, and the entrainment capacity for the gas in the pump cavity is the strongest.

At the end of self-priming, the sliding check core 23 gradually falls back under its own gravity, and the elasticity of the upper limit spring 22 and the lower limit spring 17. When the bottom end of the second-stage round platform-shaped exit section 32 is below the upper surface of the primary separation plate 12, the liquid collected in the tertiary entrainment cavity 11 during the self-priming process falls back into the primary entrainment cavity 29 through the second-stage round platform-shaped exit section 32, the first-stage round platform-shaped exit section 33, and the secondary entrainment pipe 35. At this time, since the inlet of the primary entrainment pipe 34 is located below the lower surface of the secondary separation plate 16, the liquid in the tertiary entrainment cavity 11 returns to the primary entrainment cavity 29 through the primary entrainment pipe 34.

Since the thrust valve 24 fits the sliding valve 26, the top surface of the thrust valve 24 is flush with the bottom surface of the outlet 37 of the inner pipeline in the sliding valve 26 along an axial direction of the elliptical cross-section pipeline 19. Therefore, the liquid returning to the primary entrainment cavity 29 passes through the inner surface of the thrust valve 24, and falls back into the pump body 2 through the outlet 37 of the inner pipeline, the inlet 38 of the inner pipeline, and the entrainment hole 25 for the pump cavity. When the gas pressure in the primary entrainment cavity 29 gradually rises, the sliding valve 26 gradually slides back down to the bottom end of the elliptical cross-section pipeline 19, thereby allowing the entrainment hole 25 for the pump cavity to be closed, which ensures the tightness of the hemispherical entrainment system. At this time, the air in the pump body 2 is completely exhausted and the normal operating conditions are carried out.

The examples are preferred embodiments of the present invention, but the present invention is not limited to the above embodiments. Without departing from the essence of the present invention, any obvious improvements, replacements or variations that can be made by those skilled in the art all fall within the protection scope of the present invention.

What is claimed is:

1. A hemispherical entrainment-type high-flow self-priming centrifugal pump, comprising a hemispherical entrainment system, a pump body and a pump inlet pipe, wherein the hemispherical entrainment system is disposed above the pump body and comprises an elliptical cross-section pipeline, a housing, a primary separation plate, a secondary separation plate, a spherical entrainment upper cover plate, a spherical entrainment lower cover plate and a sliding check core, wherein the elliptical cross-section pipeline is inclined upward at a certain angle and has a top end connected to a bottom end of the housing, the housing is vertically arranged, the secondary separation plate is disposed in the housing and has a periphery connected to an inner wall of the housing, and the primary separation plate is disposed at a top end of the housing, each of the primary separation plate and the secondary separation plate is provided with a through-hole at a center thereof, and the sliding check core is connected with the through-holes at the centers of the primary separation plate and the secondary separation plate in a manner of a sliding pair, and the primary separation plate, the secondary separation plate and the housing constitute a secondary entrainment cavity therebetween, the secondary separation plate and the elliptical cross-section pipeline constitute a primary entrainment cavity therebetween, and the secondary entrainment cavity is in communication with the pump inlet pipe;

each of the spherical entrainment upper cover plate and the spherical entrainment lower cover plate has a bottom end connected to the primary separation plate, and the spherical entrainment upper cover plate and the spherical entrainment lower cover plate are engaged with each other to form a spherical entrainment interior cavity having a cross-section that is double circular, and the spherical entrainment interior cavity is a double circular pipeline that ascends in a spiral overlapping manner to wrap a hemispherical surface, the double circular pipeline has a bottom inlet connected to an air inlet, and a top outlet connected to an air outlet, and the spherical entrainment lower cover plate and the primary separation plate constitute a tertiary entrainment cavity therebetween, the spherical entrainment lower cover plate has spherical entrainment through-holes evenly distributed thereon, and the spherical entrainment through-holes communicate the tertiary entrainment cavity with the spherical entrainment interior cavity;

the sliding check core has a top end and a bottom end limited by an upper limit spring and a lower limit spring, respectively, and is provided with a plurality of primary entrainment pipes and secondary entrainment pipes thereinside, the primary entrainment pipes are respectively in communication with the secondary entrainment pipes, and the primary entrainment pipes and the secondary entrainment pipes are both evenly distributed circumferentially around an axis of the sliding check core, wherein in an initial state, each of the primary entrainment pipes has a top outlet being directly opposite the primary separation plate, and a bottom inlet being directly opposite the secondary entrainment cavity, and each of the secondary entrainment pipes has a top port in communication with a respective one of the primary entrainment pipes, and a bottom port located at a bottom surface of the sliding check core; and the elliptical cross-section pipeline is provided with a sliding valve thereinside, the sliding valve has an elliptical cylindrical structure and is provided with an inner pipeline, the inner pipeline has an outlet having a direction that is parallel to a central axis of the elliptical cross-section pipeline, and an inlet has a direction perpendicular to the central axis of the elliptical cross-section pipeline, the sliding valve is connected with an inner wall of the elliptical cross-section pipeline in a manner of a sliding pair, the elliptical cross-section pipeline is provided with an entrainment hole for a pump cavity, and during upward and downward sliding movement of the sliding valve, the inlet of the inner pipeline is configured to be in communication or misalignment with the entrainment hole for the pump cavity, the elliptical cross-section pipeline is provided with a thrust valve on the inner wall, the thrust valve is located above the sliding valve and is used to limit a position where the sliding valve slides upward, the sliding valve and a bottom surface of the elliptical cross-section pipeline constitute a gas storage cavity therebetween, and the elliptical cross-section pipeline is provided with a vent hole on the bottom surface thereof, and the vent hole is used to communicate the gas storage cavity with an atmosphere.

2. The hemispherical entrainment-type high-flow self-priming centrifugal pump according to claim 1, wherein a second-stage round platform-shaped exit section and a first-stage round platform-shaped exit section are sequentially provided at the top outlet of each of the primary entrainment pipes on the sliding check core, the second-stage round platform-shaped exit section and the first-stage round platform-shaped exit section have a same central axis, and the second-stage round platform-shaped exit section has a diameter larger than that of the first-stage round platform-shaped exit section, and in the initial state, the second-stage round platform-shaped exit section is directly opposite the primary separation plate.

3. The hemispherical entrainment-type high-flow self-priming centrifugal pump according to claim 2, wherein the sliding check core is provided with a plurality of drainage nozzles thereinside, which are evenly distributed circumferentially around the central axis of the first-stage round platform-shaped exit section, and each of the drainage nozzles extends from the first-stage round platform-shaped exit section to the second-stage round platform-shaped exit section, and becomes a constricted jet nozzle at an outlet of each of the drainage nozzles.

4. The hemispherical entrainment-type high-flow self-priming centrifugal pump according to claim 1, wherein each of the primary entrainment pipes has an inclined contraction section and a one-turn section sequentially from the bottom inlet to the top outlet, and each of the secondary entrainment pipes has an inclined contraction section and a vertical contraction section sequentially from the bottom port to the top port, and the top port of each of the secondary entrainment pipes is in communication with the inclined contraction section of each of the primary entrainment pipes.

5. The hemispherical entrainment-type high-flow self-priming centrifugal pump according to claim 1, wherein the sliding check core is provided with an upper positioning groove at the top end, the upper limit spring has a bottom end installed in the upper positioning groove, and a top end connected with a positioning ball which is installed above the top end of the sliding check core via a limit bracket; and the sliding check core is provided with a positioning groove at the bottom end, and the lower limit spring has a top end fixed in the positioning groove, and a bottom end fixed in a lower positioning groove located on an inner surface of the elliptical cross-section pipeline.

6. The hemispherical entrainment-type high-flow self-priming centrifugal pump according to claim 5, wherein a ratio of elastic modulus of the upper limit spring to the lower limit spring is 1:2.

7. The hemispherical entrainment-type high-flow self-priming centrifugal pump according to claim 1, wherein the thrust valve has a right triangle-shaped cross-section, and along an axial direction of the elliptical cross-section pipeline, a top surface of the thrust valve is flush with a bottom surface of the outlet of the inner pipeline in the sliding valve.

8. The hemispherical entrainment-type high-flow self-priming centrifugal pump according to claim 5, wherein the thrust valve sweeps through an elliptical ring of 120° on the inner surface of the elliptical cross-section pipeline.

9. The hemispherical entrainment-type high-flow self-priming centrifugal pump according to claim 1, wherein the gas storage cavity is semi-ellipsoidal in shape.

10. The hemispherical entrainment-type high-flow self-priming centrifugal pump according to claim 1, wherein the primary separation plate has an upper surface which is an oblique plane inclined downward, and a lower surface which is an arc surface inclined downward.

* * * * *